United States Patent [19]

Iwata

[11] Patent Number: 4,525,943

[45] Date of Patent: Jul. 2, 1985

[54] MOVABLE CALENDER MARKER

[76] Inventor: Shuji Iwata, 68-2, 3-chome, Shimoishihara, Chofu 182, Japan

[21] Appl. No.: 530,641

[22] Filed: Sep. 9, 1983

[30] Foreign Application Priority Data

Sep. 21, 1982 [JP] Japan ..... 57-141861[U]

[51] Int. Cl.[3] ..... G09D 3/00

[52] U.S. Cl. ..... 40/110; 40/594; 40/618; 248/205.3

[58] Field of Search ..... 40/110, 618, 594; 248/205.3

[56] References Cited

U.S. PATENT DOCUMENTS

| | | | |
|---|---|---|---|
| 3,165,283 | 1/1965 | Borisof | 248/205.3 |
| 3,504,878 | 4/1970 | Dressler | 248/205.3 |
| 3,919,796 | 11/1975 | Shimazaki | 40/110 |
| 4,039,134 | 8/1977 | Redmer | 248/205.3 |

FOREIGN PATENT DOCUMENTS

| | | | |
|---|---|---|---|
| 272272 | 6/1927 | United Kingdom | 40/110 |

*Primary Examiner*—Gene Mancene
*Assistant Examiner*—Venceslao J. Contreras

[57] ABSTRACT

A new calender marker composed of a frame member having a window therein and fixing means provided on the frame member to attach said calendar marker to a calendar sheet. Said fixing means is specifically at least one protuberance provided on one side of the frame member and having a recess therein. Said recess has a small diameter section formed in the outer side thereof and a large diameter section formed in the inner side thereof. Manually deformable sticky plastic material is charged into said recess such that a portion thereof project from the recess.

8 Claims, 5 Drawing Figures

MOVABLE CALENDER MARKER

BACKGROUND OF THE INVENTION

This invention relates to a movable calendar marker for indicating the current date and, more particularly, to a movable calendar marker used with a hanging type monthly calendar.

Nowadays, our daily life is led with the aid of highly advanced electric apparatuses; for instance computers are being introduced in every field, making our life highly efficient. However, one is so urged by daily business to catch up with general social situations, get access to various pieces of information, pay much attention to complicated human relations, make preparations for the future or do various other things that he is liable to become forgetful of things.

Remembering dates is not an exception. For example, one often forgets the current date and the remaining days of the month despite of the presence of monthly calendars at home and at the office, a display of the current date in railway stations and like places. In such cases, one often makes a mistake as to appointment or a good business chance.

In order to obviate the difficiencies noted above, there has been proposed a calendar date indicator, which consists of a movable ring consisting of a permanent magnet movable along the surface of a conventional calendar and a driven ring consisting of a permanent magnet movable along the calendar surface with the movable ring (as disclosed in Japanese Utility Model Registration Publication No. 54-27750). Such ring-like permanent magnets, however, require very cumbersome operation in manufacture, particularly when separating them from molds. Also, they can be magnetized rather insufficiently. Further, their rigidity is insufficient. Furthermore, their cost is high and they have a short life span. Moreover, because they are ring-like, their gaus number is less than that of a solid permanent magnet having the same diameter, so that their attraction force is weaker.

To overcome the drawbacks mentioned, the applicant has proposed a movable calendar marker, which comprises a marker body slidable over the surface of a hanging type monthly calendar to the position of the figure of the current date, said marker body having a window for showing the current date therethrough and a permanent magnet attached to the upper edge, and a driven permanent magnet attracted to the first-mentioned permanent magnet on the back side of the monthly calender for movement therewith (as disclosed in Japanese Utility Model Registration Publication No. 56-48673). Various models of this movable calendar marker are now being trial manufactured by the applicant, and it has been confirmed that the intended end is sufficiently attained.

BACKGROUND OF THE INVENTION

The movable calendar marker according to the invention, although it is the same as the one described above insofar as a display frame having an upper projection is used, it is based on an entirely different principle as to the mechanism of attraction to the calendar and utilizes techniques based on this idea. More particularly, the invention seeks to provide a low cost movable calendar marker which does not use any permanent magnet but instead uses sticky plastic members. Unlike the prior art calendar marker, which uses a permanent magnet as a marker body or in the form secured to a marker body and a driven permanent magnet co-operative with the first-mentioned permanent magnet, with the movable calendar marker according to the invention there is no possibility of falling off of the driven permanent magnet.

Another object of the invention is to provide a movable calendar marker, which permits an easy date display change operation.

A further object of the invention is to provide a movable calendar marker, in which a sticky plastic member is pressure fitted in a large diameter opening portion pf a protuberance member through a small diameter opening thereof, so that the sticky plastic member is never detached in use and, if the stickiness is reduced, it can be restored by rubbing the member or the member can be readily replaced with a new one.

BRIEF DESCRIPTION OF THE DRAWINGS

Embodiments of the invention to attain the above objects will now be described in detail with reference to FIGS. 1 through 5 in which.

DETAILED DESCRIPTION OF THE PREFERRED EMBODIMENTS

Designated at a is a marker body made from a comparatively thin synthetic resin plate (e.g., a vinyl chloride plate with a thickness of 0.3 to 2 mm) or a comparatively thick paper sheet (e.g., one with a thickness of 1.0 to 1.5 mm). It has a frame member 2 having a central window 1 and an upper enlarged section 2*a*.

Figure 1:
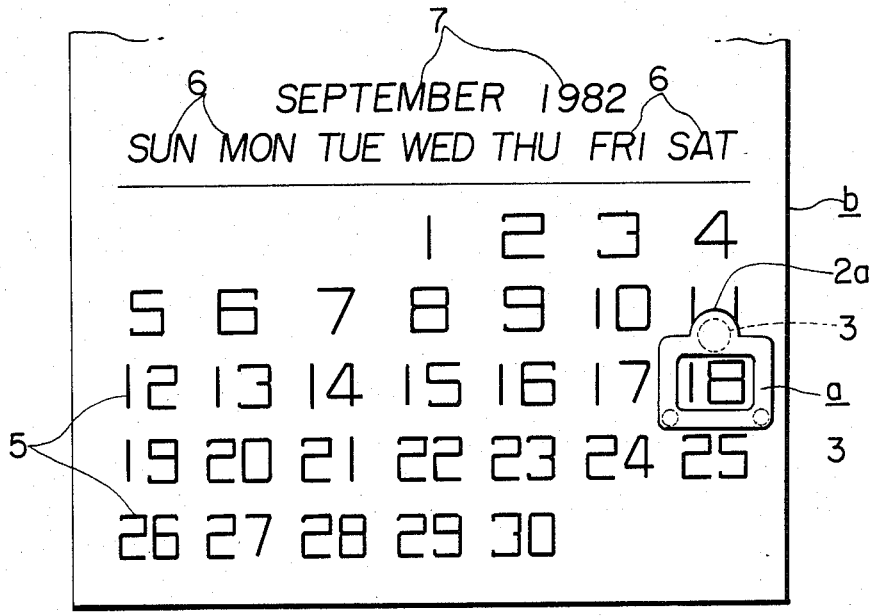
FIG. 1 is a front view showing the movable calendar marker according to the present invention in use.
Figure 2:
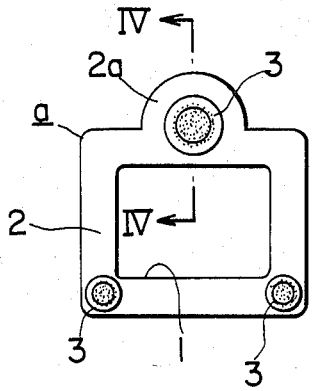
FIG. 2 is a back view of a marker frame of the movable calendar marker.
Figure 3:
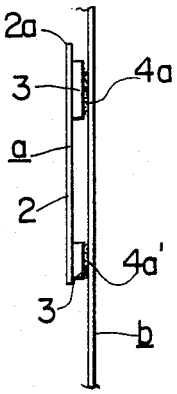
FIG. 3 is a top view of the same.
Figure 4:
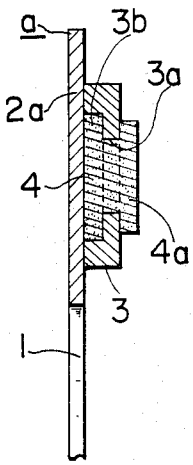
FIG. 4 is an enlarged-scale sectional view taken along line IV—IV in FIG. 2.

It has protuberance members 3 made of the same material as it. As shown in FIG. 4, each procuberance member 3 is formed with a recess having a small diameter section 3*a* formed in an outer side thereof and a large diameter section 3*b* formed in an inner side and communicating with the small diameter section 3*a*. In this example, the marker has three such protuberance members 3, one applied to the back side of the upper enlarged section of the frame 2 and the other two applied to the back side of the left and right corner portions of the frame 2 such that the large diameter section 3*b* is closed by the frame member 2.

Reference numeral 4 designates manually deformable plastic material having stickiness. This sticky plastic material 4 is pressure fitted into the recess of each protuberance member 3 through the small diameter section 3*a*. A portion 4*a* of it projects slightly from the small diameter section 3*a*.

Designated at b is a hanging type monthly calendar. Like the conventional one, it has impressions 5 of figures "1" to "30" or "1" to "31" representing the days of the month, abbreviation symbols 6 representing the days of the week and letters and figures 7 representing the month and year.

In use of the marker having the construction described above, the frame member a is applied to the monthly calendar b by pushing it against the surface of the monthly calendar b such that the current day is seen through the window 1. To change the position of the marker, the frame 2 is pulled away and then attached again to the position of the next day. When the stickiness of the sticky plastic material 4 is reduced, it may be pulled out slightly from the small diameter section 3*a* and scraped with the fingers to obtain a new surface, or it may be replaced with a new one.

While an embodiment of the invention has been described, it is by no means limitative; for instance the following modifications are possible.

(1) The protuberance members 3 need not be three in number; only a single protuberance member may be applied to the back side of the upper enlarged section 2*a* of the frame member 2, or two or four such protuberance members may be applied to the frame member at desired positions thereof.

Figure 5:
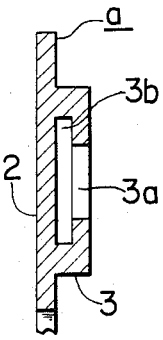
FIG. 5 is a sectional view showing a different embodiment of the marker frame and protuberance.

(2) The protuberance member 3 may be formed integrally with the frame 2 as shown in FIG. 5.

As has been described in the foregoing, with the movable calendar marker according to the invention, unlike the prior art calendar marker using in combination a permanent magnet as a marker body or secured to the same and a driven permanent magnet, there is no possibility of fall of the driven permanent magnet because of the use of the sticky plastic material having the function of being stuck instead of using any permanent magnet. In addition, it can be obtained inexpensively, and the date display change can be done easily. Further, the sticky plastic material which is pressure fitted in a large diameter opening portion of the protuberance member through the small diameter section thereof, never falls during use, and if its stickiness is reduced, the stickiness can be readily recovered by scraping it or it can be readily replaced with a new one.

What is claimed is:

1. A movable calendar marker comprising:

a frame member having a window therein; and means for fixing said frame member to a calendar sheet, said fixing means being provided at one side of said frame member and having a recess therein, said recess having a small diameter section formed in an outer side thereof and a large diameter section formed in an inner side thereof, said recess containing a manually deformable sticky plastic material, a portion of said sticky plastic material projecting from said recess.

2. A movable calendar marker according to claim 1, wherein said frame member has an enlarged section formed at a top center portion thereof.

3. A movable calendar marker according to claim 1, wherein said fixing means includes at least one protuberance having said recess therein.

4. A movable calendar marker according to claim 3, wherein said protuberance is positioned in said enlarged section.

5. A movable calendar marker according to claim 1, wherein said fixing means includes a plurality of protuberances each having said recess therein.

6. A movable calendar marker according to claim 2, wherein said fixing means includes first, second, and third protuberances each having said recess therein, said first protuberance being positioned in said enlarged section and said second and third protuberances being positioned in the frame member symmetrically with respect to said first protuberance.

7. A movable calendar marker according to claim 3, wherein said at least one protuberance includes a separate member attached to the frame member.

8. A movable calendar marker according to claim 3, wherein said at least one protuberance is formed integrally with said frame member.

* * * * *